United States Patent [19]

Stewart

[11] Patent Number: 4,923,235

[45] Date of Patent: May 8, 1990

[54] HANDLE

[75] Inventor: Peter D. Stewart, Windsor, Canada

[73] Assignee: Wolverine Aluminum Distributing Ltd., Windsor, Canada; a part interest

[21] Appl. No.: 302,783

[22] Filed: Jan. 30, 1989

[51] Int. Cl.[5] ..... A45C 13/26; B65D 33/06

[52] U.S. Cl. ..... 294/141; 294/171; 383/13

[58] Field of Search ..... 294/137, 141–143, 294/146, 149, 151, 153, 154, 159, 165, 167, 170, 171; 16/114 R, 114 B; 220/94 R, 96; 229/52 A; 383/6, 13, 25, 26, 29

[56] References Cited

U.S. PATENT DOCUMENTS

| | | | |
|---|---|---|---|
| 645,670 | 3/1900 | Ottignon | 294/171 |
| 1,268,775 | 6/1918 | Stanger | 294/171 |
| 1,576,546 | 3/1926 | Ransom | 294/171 |
| 2,547,343 | 4/1951 | O'Loughlin | 294/171 |
| 3,083,366 | 3/1963 | Franges | 294/171 |
| 3,670,937 | 6/1972 | Bradshaw | 294/171 |

FOREIGN PATENT DOCUMENTS

| | | | |
|---|---|---|---|
| 85524 | 8/1983 | European Pat. Off. | 294/171 |
| 761947 | 11/1956 | United Kingdom | 294/171 |
| 2153213 | 8/1985 | United Kingdom | 294/171 |

*Primary Examiner*—Johnny D. Cherry

*Attorney, Agent, or Firm*—Allen D. Gutchess, Jr.

[57] ABSTRACT

A handle particularly for use with plastic grocery bags is disclosed. The bag is of the type having two side walls with openings near the top for carrying the bag. The elongate handle is substantially rigid and the ends of the handle have notches which receive edges of the side walls at the openings. The notches are shaped such that the handle will not accidentally separate from the bag when it is set down. In a preferred form, the handle is of thin plastic which is arcuate in transverse cross section and placed in the bag opening so that the convex side faces downwardly. An intermediate part of the handle can have two longitudinally-spaced openings to receive hanger hooks to facilitate carrying clothes in a clothes bag when traveling.

6 Claims, 2 Drawing Sheets

HANDLE

This invention relates to a handle to facilitate carrying bags, particularly plastic grocery bags and the like.

The use of these plastic grocery bags in place of conventional heavy paper ones is becoming quite common. The plastic bags represent a considerable savings in cost for the retailer. Such a bag usually has thin side walls with openings near the tops with the customer carrying the bag by inserting a hand partially through both openings. Particularly with heavier contents, the bags can be somewhat uncomfortable to carry. Further, with heavier contents, the walls of the bags can distort and tear at the openings.

The handle can be manufactured at low cost and supplied to the customer with the bag at checkout counters. The intermediate portion of the handle also provides a relatively large area to carry advertising indicia or the like.

Various bag handles have heretofore been known in the art, as shown in U.S. Pat. Nos. 391,896; 499,481; 1,468,848; 2,041,691; 2,448,894; 3,670,937; 3,800,361; and 4,590,640. However, because of the design or costs or both, they are unsuitable or less than suitable for the purpose of the instant invention.

A handle in accordance with the invention is particularly designed for use with plastic grocery bags and is also adaptable for the carrying of other types of bags. The handle is preferably made of plastic material such a polypropylene and is substantially rigid throughout its length. The handle has two similar notches at opposite ends with the notches being substantially symmetrical about a central, longitudinal axis of the handle. Each notch has substantially straight edges extending diagonally inwardly toward one another from the corners of the handle end. The straight edges terminate at ends or points which are spaced apart distances exceeding the thickness of two side walls of the bag. Each of the notches has an opening beyond the straight edges toward the opposite end of the handle and communicating with the space between the inner ends of the straight edges. With this design, once the handle is inserted in the openings with the side walls of the bag engaged in the notches, the handle will remain engaged with the bag and not separate from it when the bag is set down.

In a preferred form, the handle is made of a plastic strip which is of arcuate configuration in transverse cross section with the handle placed in the openings of the bag with the convex side of the handle facing downwardly.

In another form, the handle can be molded and be much thicker, with rounded edges but with similar notches in the ends. The handle can also have two intermediate openings to receive a hook of a clothes bag or the hooks of hangers extending from the upper end of the clothes bag. The handle then provides a comfortable grip to facilitate carrying the bag when traveling, as through airports, for example.

It is, therefore, a principal object of the invention to provide a handle to facilitate carrying bags.

Another object of the invention is to provide a low cost hanger for carrying plastic grocery bags and the like.

Other objects and advantages of the invention will be apparent from the following detailed description of preferred embodiments thereof, reference being made to the accompanying drawings, in which.

Figure 1:
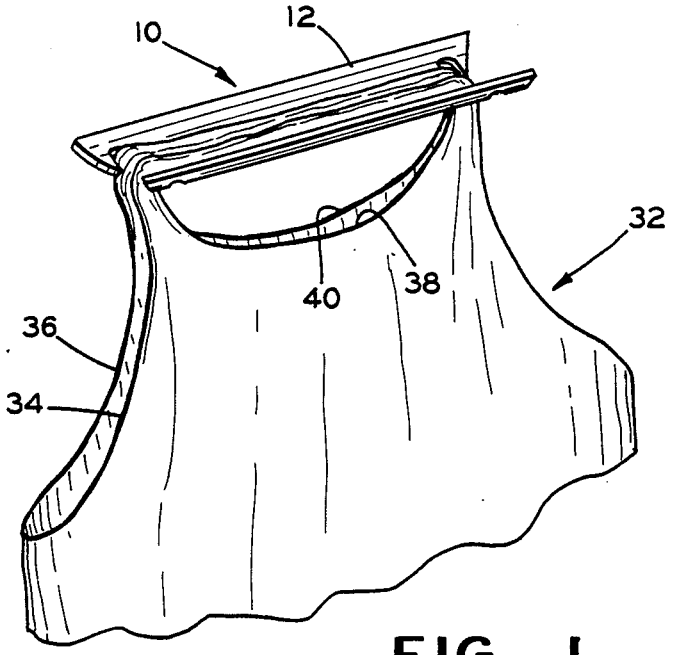
FIG. 1 is a fragmentary view in perspective of a plastic grocery bag and a handle in accordance with the invention.
Figure 2:
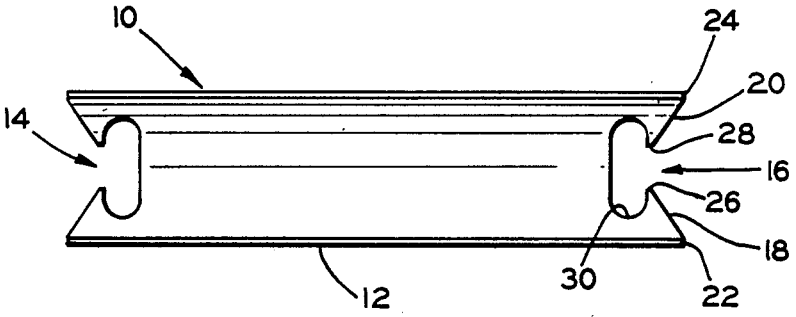
FIG. 2 is a top view of the handle of FIG. 1.
Figure 4:
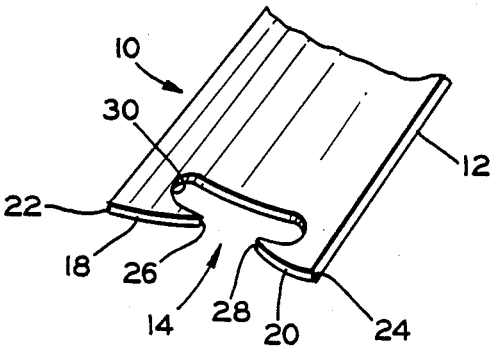
FIG. 4 is a fragmentary view in perspective of the handle showing an end notch thereof.
Figure 3:
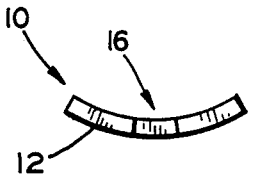
FIG. 3 is an end view of the handle of FIGS. 1 and 2.

Referring to FIGS. 1–4, a handle 10 is shown in accordance with preferred embodiment of the invention. The handle is substantially rigid and is made of a strip 12 of plastic material, such as polypropylene, which is relatively inexpensive and can flex somewhat without bending. The strip is preferably about one-eighth inch thick and can be from one-sixteenth inch to three-sixteenth inch in thickness. The handle is preferably of uniform thickness throughout its length and width and is of arcuate configuration in transverse cross section, as best shown in FIG. 2. The handle is used with the convex side facing downwardly with the arcuate configuration providing both comfort to the user and strength for the handle.

The handle 10 has two similar end notches 14 and 16 at the ends of strip 12. Each of the notches is substantially symmetrical about a central, longitudinal axis of the strip. Each has substantially straight edges 18 and 20 which extend diagonally inwardly toward one another from corners 22 and 24 of the strip 12. The edges 18 and 20 terminate at inner ends or points 26 and 28 which are spaced apart a distance exceeding the thickness of two side walls of a bag with which the handle is to be used. Each of the notches 14 and 16 also has an opening 30 located in the strip 12 toward the opposite end of the strip and communicating with the space between the inner ends 26 and 28 of the notches. The shape of the notches with the diagonal edges 18 and 20 facilitates engaging a bag with the handle 10. the notches also substantially reduce the possibility of the handle being separated from the bag, particularly when the bag is set down.

A plastic bag with which the handle 10 can be used is indicated at 32 in FIG. 1. The bag 32 has thin plastic side walls 34 and 36 with round openings 38 and 40 near the tops thereof. The diameters of the openings 38 and 40, or the maximum transverse horizontal distances thereacross, if the openings. are not circular, are preferably slightly less than the overall length of the handle 10. The handle 10 can then be engaged with the bag by inserting one of the notches 14 and 16 with the edges of the side walls 34 and 36 at the openings 38 and 40, after which the other notch is engaged with the opposite edges of the openings. With the barb-like configuration achieved with the design of the notches 14 and 16, the handle 10 will not readily separate from the bag 32 when the bag is set down and the side walls 34 and 36 become limp.

The straight handle, with the rounded configuration, provides a more comfortable grip on the bag for the customer, particularly when the contents of the bag are heavy. Further, the handle 10 distributes the weight of the contents over substantial portions of the edges of the side walls 34 and 36 at the openings 38 and 40 when the bag is lifted. This substantially reduces distortion and tearing of the bag at the openings 38 and 40 which can and does occur, particularly with heavy items in the bag. The handle also has a relatively large, smooth, unbroken surface for carrying advertising indicia, and the like.

Figure 5:
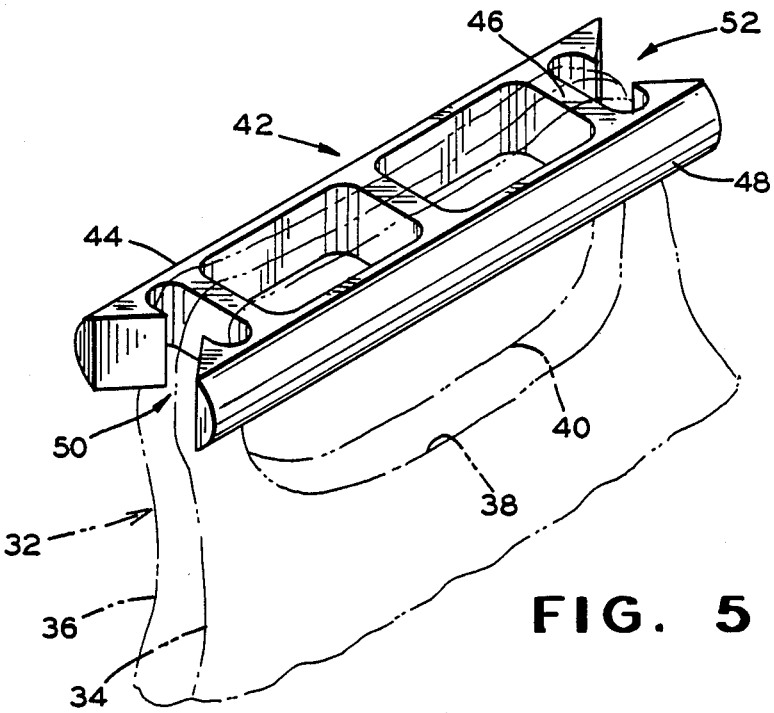
FIG. 5 is a view similar to FIG. 1 of a bag and a modified handle.
Figure 6:
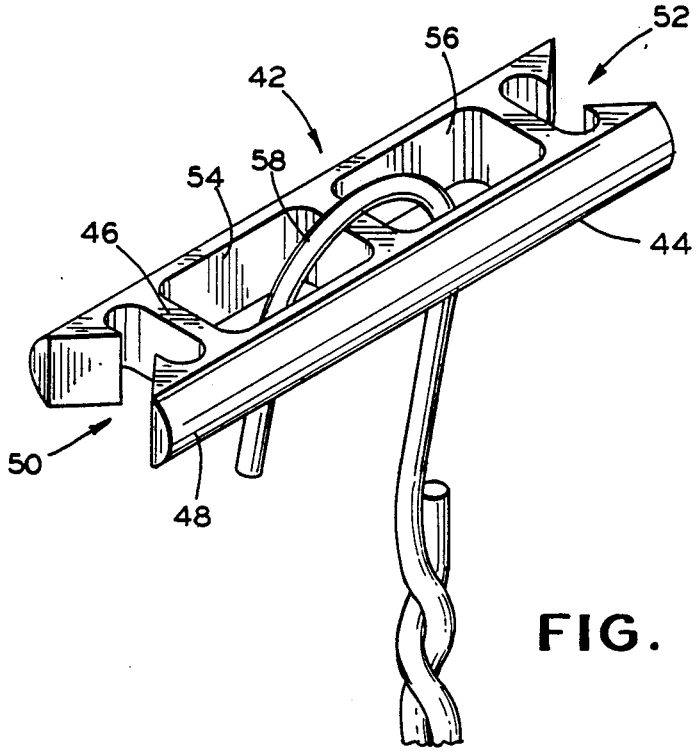
FIG. 6 is a view in perspective of the handle of FIG. 5 shown carrying a hook.

A modified, thicker handle embodying the invention is indicated at 42 in FIGS. 5 and 6. The handle in this instance is an elongate bar 44 which can be molded of plastic material. It has flat upper and lower surfaces 46 and rounded edges 48. The handle 42 also has end notches 50 and 52 which are shaped similar to the notches 14 and 16.

The handle 42 can be used with the bag 32, shown in dotted lines. The bag 32 has the side walls 34 and 36 which have the rounded openings 38 and 40 near the top. The handle 42 engages the side walls of the bag at the openings 38 and 40 in the same manner as the handle 10 and has similar advantages in facilitating the carrying of the bag.

The handle 42, in this instance, also has two intermediate openings 54 and 56 between the notches 50 and 52. These can receive a hook 58 of a clothes hanger or of a clothes bag if the bag has its own carrying hook. If a number of hangers extend from the top of the bag, they can all be received in the openings 54 and 56 to facilitate carrying the bag. This is particularly advantageous to one carrying the bag an extended distance, such as through airports.

Various modifications of the above-described embodiments of the invention will be apparent to those skilled in the art and it is to be understood that such modifications can be made without departing from the scope of the invention, if they are within the spirit and the tenor of the accompanying claims.

I claim:

1. In combination, a plastic bag for groceries and other items, said bag having two side walls with openings near the tops, an elongate, substantially rigid handle having two similar notches at opposite ends, each of said notches being substantially symmetrical about a central, longitudinal axis of said handle and having substantially straight edges extending diagonally inwardly toward one another from corner portions at the handle end, said substantially straight edges terminating at inner ends which are spaced apart a distance exceeding the thickness of the two side walls of said bag, each of said notches having an opening in said handle located toward the opposite end of the handle and communicating with the space between the inner ends of said edges, said handle openings and said straight edges forming barb-like points at the inner ends of said straight edges, the distance between closest portions of said handle openings being less than the maximum transverse horizontal distances across said bag openings.

2. The combination according to claim 1 characterized by said handle being made of thin plastic material of arcuate configuration in transverse cross section, said handle being placed in said openings of said bag with the convex side of the handle facing downwardly.

3. The combination according to claim 1 characterized by an intermediate portion of said handle having two longitudinally-spaced openings to receive a hanger hook of a bag.

4. An elongate, substantially rigid handle for carrying a plastic bag having side walls with openings near the tops, said handle being a substantially rigid plastic strip of shallow arcuate configuration in transverse cross section, said handle having two similar notches at opposite ends, each of said notches having a barb-like configuration, each of said notches being substantially symmetrical about a central, longitudinal axis of said handle, each of said notches having substantially straight diagonal edges extending diagonally inwardly toward one another from corners of the handle end, said substantially straight edges terminating at inner ends, each of said notches having an opening in said handle located toward the opposite end of said handle and communicating with the space between the inner ends of said straight edges, said handle openings and said straight edges forming sharp points at the inner ends of said straight edges.

5. An elongate handle according to claim 4 characterized by an intermediate portion of said handle between said notches being smooth and unbroken to receive indicia.

6. An elongate handle according to claim 4 wherein each of said handle openings is elongate in a direction transverse to the longitudinal axis of said handle and has substantially straight, aligned edges which form said sharp points with said diagonal straight edges.

* * * * *